US005461284A

United States Patent [19]

Roberts et al.

[11] Patent Number: 5,461,284

[45] Date of Patent: Oct. 24, 1995

[54] VIRTUAL FIXTURE FOR REDUCING ELECTROMAGNETIC INTERACTION BETWEEN AN ELECTRODELESS LAMP AND A METALLIC FIXTURE

[75] Inventors: Victor D. Roberts, Burnt Hills; Sayed-Amr El-Hamamsy, Schenectady, both of N.Y.; Timothy A. Taubert, Kirtland; James D. Mieskoski, Seven Hills, both of Ohio

[73] Assignee: General Electric Company, Schenectady, N.Y.

[21] Appl. No.: 220,862

[22] Filed: Mar. 31, 1994

[51] Int. Cl.[6] ..... H01J 7/44

[52] U.S. Cl. ..... 315/57; 315/248; 315/267; 315/276; 313/491; 313/493

[58] Field of Search ..... 315/56, 85, 248, 315/57, 267, 276, 344; 313/313, 491, 492, 493

[56] References Cited

U.S. PATENT DOCUMENTS

| | | | |
|---|---|---|---|
| 4,001,631 | 1/1977 | McNeill et al. | 315/39 |
| 4,005,330 | 1/1977 | Glascock, Jr. et al. | 315/57 |
| 4,070,602 | 1/1978 | Ferro et al. | 315/248 |
| 4,187,445 | 2/1980 | Houston | 315/248 X |
| 4,187,447 | 2/1980 | Stout et al. | 315/85 |
| 4,910,439 | 3/1990 | El-Hamamsy et al. | 315/248 |
| 4,940,923 | 7/1990 | Kroontje et al. | 315/248 |
| 5,006,763 | 4/1991 | Anderson | 315/248 |
| 5,325,018 | 6/1994 | El-Hamamsy | 315/85 |

*Primary Examiner*—Robert J. Pascal
*Assistant Examiner*—Haissa Philogene
*Attorney, Agent, or Firm*—Jill M. Breedlove; Marvin Snyder

[57] ABSTRACT

An electrodeless lamp (e.g., an electrodeless fluorescent lamp) includes a dielectric housing shaped to conform to a portion of a lamp envelope, which housed portion is opposite to a portion through which light is emitted. The dielectric housing includes a continuous conductor, i.e., a shorted turn, situated between the dielectric housing and the lamp envelope which conforms to at least a portion of the dielectric housing. The configuration of the shorted turn, in terms of the location and amount of surface area occupied thereby, is optimized to minimize interaction between the excitation coil and any metallic fixture and to avoid interfering with lamp starting and light output.

18 Claims, 4 Drawing Sheets

VIRTUAL FIXTURE FOR REDUCING ELECTROMAGNETIC INTERACTION BETWEEN AN ELECTRODELESS LAMP AND A METALLIC FIXTURE

FIELD OF THE INVENTION

The present invention relates generally to electrodeless lamps and, more particularly, to apparatus, i.e., a "virtual fixture", for reducing variations in performance of an electrodeless lamp when operating within or without an electrically conductive fixture.

BACKGROUND OF THE INVENTION

Unfortunately, installation of an electrodeless lamp (e.g., an electrodeless fluorescent lamp) in a fixture with an electrically conductive outer shell results in significant variations in lamp performance, such as changes in lamp input power, output lumens, and ballast power loss. Changes in input power and output lumens are, to say the least, an inconvenience for the consumer, but changes in ballast power loss can significantly increase ballast temperature and shorten ballast life.

The changes in lamp performance upon installation in a fixture are caused by interaction between the electromagnetic fields produced by the excitation coil in the electrodeless fluorescent lamp and the conductive shell of the fixture. This interaction changes the impedance of the loaded drive coil as viewed from the ballast, and hence changes system performance.

A typical electrodeless fluorescent lamp ballast employs a resonant circuit. One approach to maintaining nominal performance of a resonant circuit is to use a feedback circuit in which an output variable is measured and fed back to a controller. In response to the feedback, the controller changes a control variable, such as input voltage or operating frequency, in such a manner that the circuit either runs with constant output power or operates at high efficiency. Disadvantageously, such feedback control schemes are too expensive to be practicable for the ballasts of electrodeless fluorescent lamps intended for use as incandescent lamp replacements.

Accordingly, it is desirable to provide apparatus for an electrodeless fluorescent lamp which allows the ballast to be adjusted for optimized performance outside of an electrically conductive fixture, while maintaining this performance even when the lamp is installed in a fixture that is electrically conductive.

SUMMARY OF THE INVENTION

An electrodeless lamp (e.g., an electrodeless fluorescent lamp) comprises a dielectric housing shaped to conform to a portion of a lamp envelope, which housed portion is opposite to a portion through which light is emitted. The dielectric housing includes a continuous conductor, i.e., a shorted turn, situated between the dielectric housing and the lamp envelope which conforms to at least a portion of the dielectric housing. The configuration of the shorted turn, in terms of its location and amount of surface area occupied thereby, is optimized to minimize interaction between the excitation coil and any electrically conductive fixture and to avoid interfering with lamp starting and light output.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
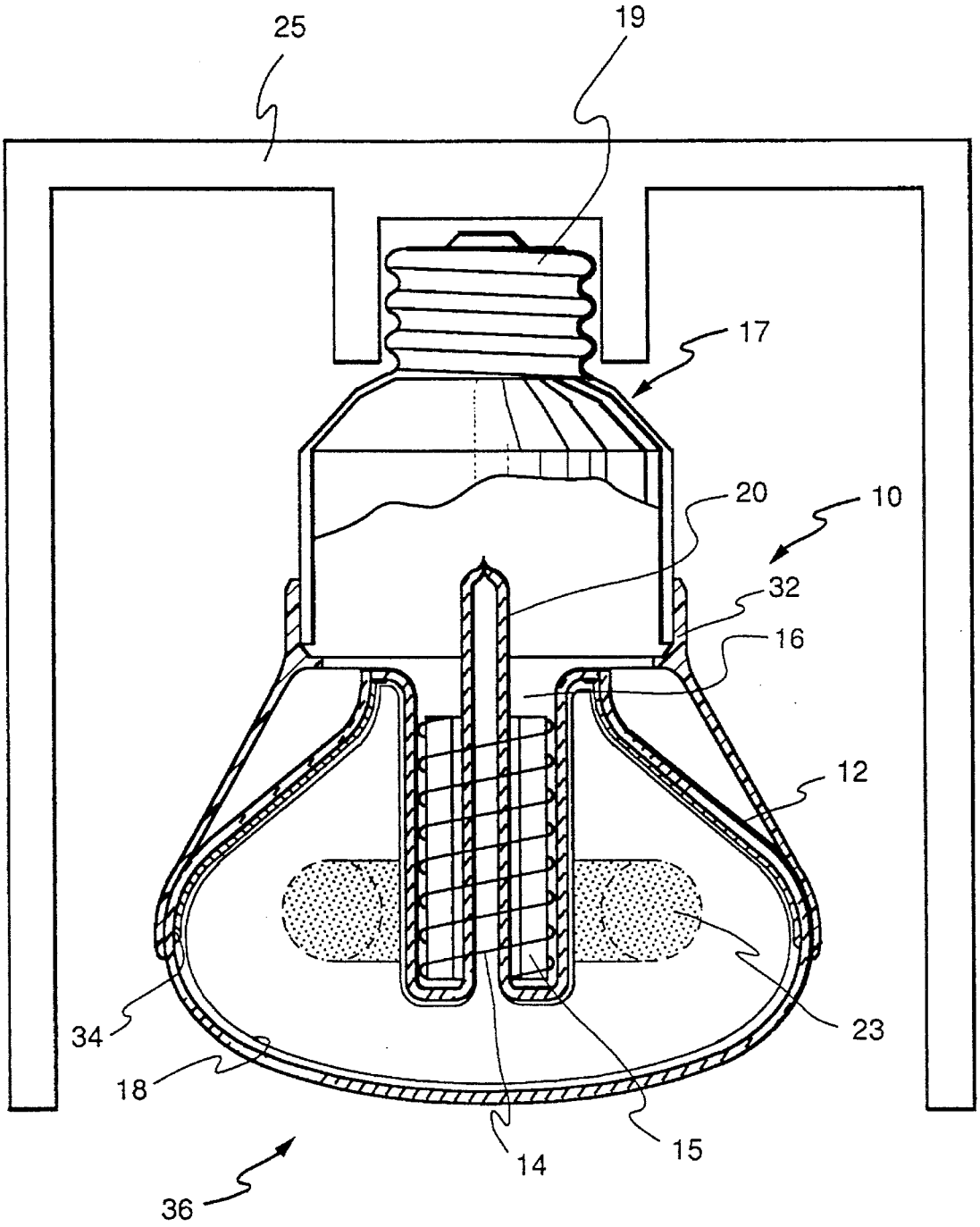
FIG. 1 (PRIOR ART)
FIG. 1 illustrates, in partial cross section, a typical electrodeless fluorescent lamp.

FIG. 1 illustrates a typical electrodeless fluorescent discharge lamp 10 having an envelope 12 containing an ionizable gaseous fill. (Although the present invention is illustrated with reference to an electrodeless fluorescent lamp, it is to be understood that the principles of the present invention apply equally to other types of electrodeless lamps which emit radiation having a wavelength in a range from approximately 100 nanometers (nm) to 1000 nm, e.g., high intensity metal halide discharge lamps.) A suitable fill, for example, for the electrodeless fluorescent lamp of FIG. 1 comprises a mixture of a rare gas (e.g., krypton and/or argon) and mercury vapor and/or cadmium vapor. An excitation coil 14 is situated within, and removable from, a re-entrant cavity 16 within envelope 12. For purposes of illustration, coil 14 is shown schematically as being wound about a magnetic core 15, i.e., having a permeability greater than one, which is situated about an exhaust tube 20 that is used for filling the lamp. Alternatively, however, the coil may be wound about the exhaust tube itself, or may be spaced apart from the exhaust tube and wound about a core of insulating material, or may be free standing, as desired. The interior surfaces of envelope 12 are coated in well-known manner with a suitable phosphor 18. Envelope 12 fits into one end of a base assembly 17 containing a radio frequency power supply (not shown) with a standard (e.g., Edison type) lamp base 19 at the other end.

Lamp 10 is illustrated as being of a reflective type; that is, light emitted within envelope 12 is reflected by a reflector, illustrated as comprising a reflective coating 34 on a portion of the interior or exterior surface of the envelope, such that light is emitted through an opposing portion 36 of the envelope. An exemplary reflective coating is comprised of titania. A dielectric housing, e.g., comprised of plastic, is illustrated as being situated around the reflective portion of envelope 12.

In operation, current flows in coil 14 as a result of excitation by a radio frequency power supply (not shown). As a result, a radio frequency magnetic field is established within envelope 12, in turn creating an electric field which ionizes and excites the gaseous fill contained therein, resulting in an ultraviolet-producing discharge 23. Phosphor 18 absorbs the ultraviolet radiation and emits visible radiation as a consequence thereof, which visible radiation is reflected by reflective coating 34 through light-emitting portion 36 of lamp 10.

Disadvantageously, if the lamp of FIG. 1 were installed in an electrically conductive fixture of well-known type for supporting lamps and directing the light emitted therefrom, the magnetic field of excitation coil 14 would induce currents in the conductive walls of the fixture. (A fixture 25 is illustrated schematically in FIG. 1.) These currents would create another magnetic field that would induce an additional current in excitation coil 14, thereby changing its operation relative to operation outside the conductive fixture.

In accordance with the present invention, an electrodeless fluorescent lamp comprises a shorted turn for minimizing interaction with any metallic lamp fixture of well-known type (not shown) for supporting lamps and directing the light emitted therefrom.

Figure 2A:
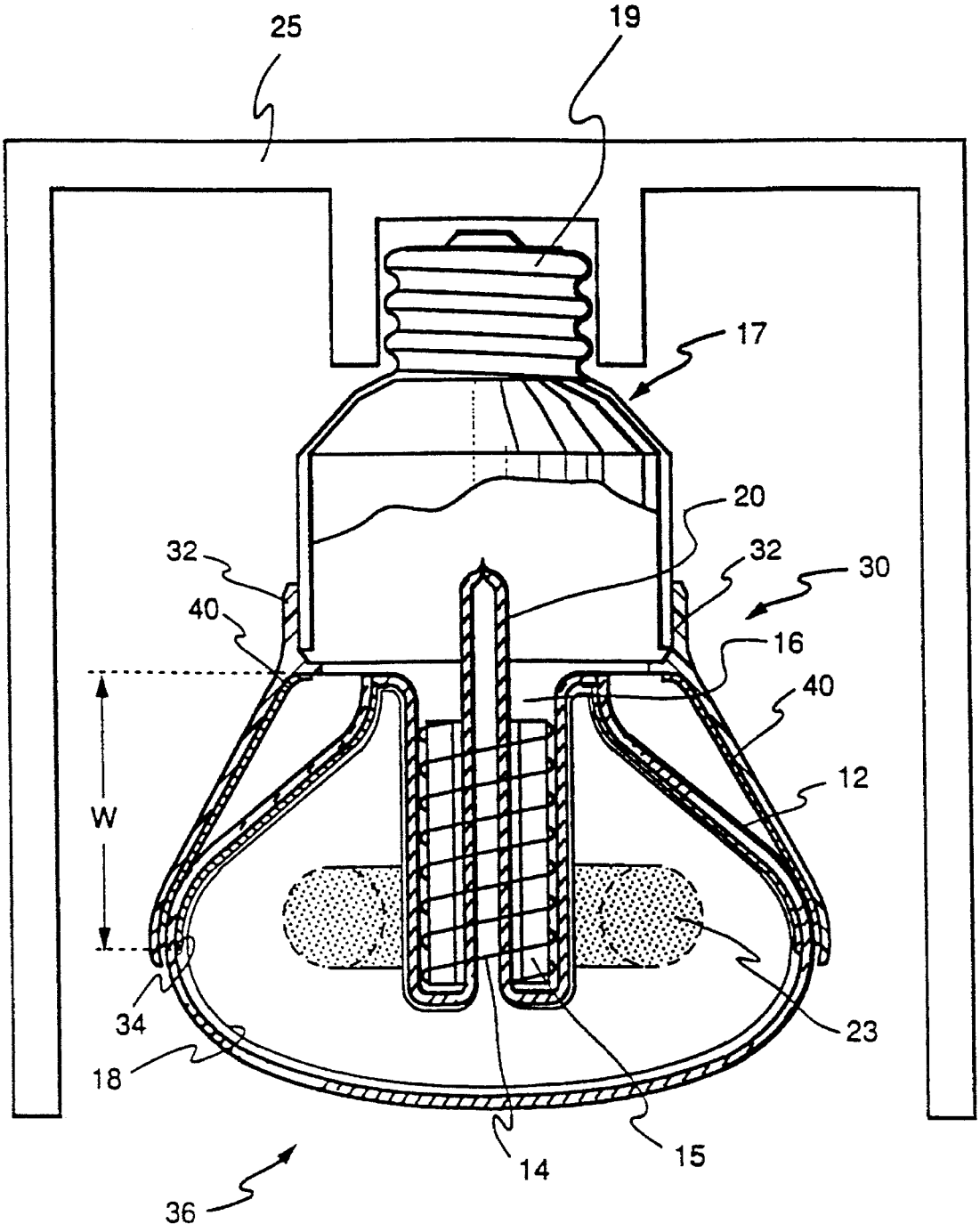
FIG. 2*a* illustrates, in partial cross section, one embodiment of an electrodeless fluorescent lamp according to the present invention.
Figure 2B:
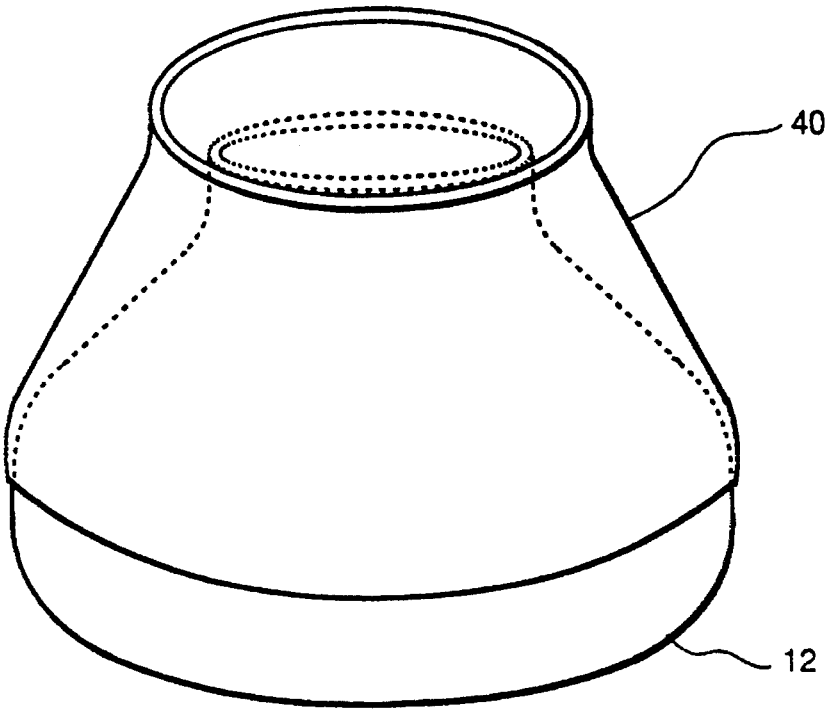
FIG. 2*b* is a perspective view of the shorted turn of the electrodeless fluorescent lamp of FIG. 2*a;*

FIGS. 2*a* and 2*b* illustrate an electrodeless fluorescent lamp 30 according to the present invention including a continuous conductor, or shorted turn, 40 which conforms to at least a portion of housing 32 and is situated between housing 32 and lamp envelope 12. The shorted turn may be attached to housing 32 in any suitable manner; for example, it may be glued, snap fit, or injection molded to the housing. Alternatively, the shorted turn may be attached to envelope 12 or may be incorporated into the housing.

Advantageously, shorted turn 40 is an ever-present conductive wall that functions to carry current in the same manner as an electrically conductive fixture; thus, the shorted turn acts as a "virtual fixture". Hence, because the shorted turn acts as a virtual fixture, the lamp can be adjusted for optimized operation as if installed in an electrically conductive fixture, even though not actually installed in one. Advantageously. therefore, performance of the lamp will not change substantially when subsequently installed in an actual fixture.

Shorted turn 40 is comprised of any suitable metal, e.g., copper, or combination of metals. The configuration of the shorted turn, in terms of its location and amount of surface area occupied thereby, is optimized to minimize interaction with any electrically conductive fixture and to avoid interfering with lamp starting and light output. In one embodiment, the thickness of the metal comprising the shorted turn is at least the skin depth at the operating frequency of the lamp to ensure that substantially all the magnetic field generated by excitation coil 14 at the location of the shorted turn induces currents to flow therein. The resistance around the shorted turn should be sufficiently low to minimize losses therein.

Dielectric housing 32 functions not only to support shorted turn 40, but also functions to protect a lamp user from potential electric shocks in case of contact with the shorted turn.

The width of the shorted turn is represented by w in FIGS. 2*a* and 2*b*. In FIGS. 2*a* and 2*b*, the shorted turn substantially covers the underside of the dielectric housing such that w is substantially the width of dielectric housing 32. The wider the shorted turn, and the farther it extends above and below the central portion, i.e., equator E, of the envelope, the better it is able to function as a virtual fixture. However, if the width is too great, then the shorted turn would interfere with stray electric fields used to start the lamp. Moreover, making the shorted turn extend beyond the reflective coating would interfere with light output. Therefore, the shorted turn should not extend beyond the portion of the envelope covered by the reflector.

Figure 3A:
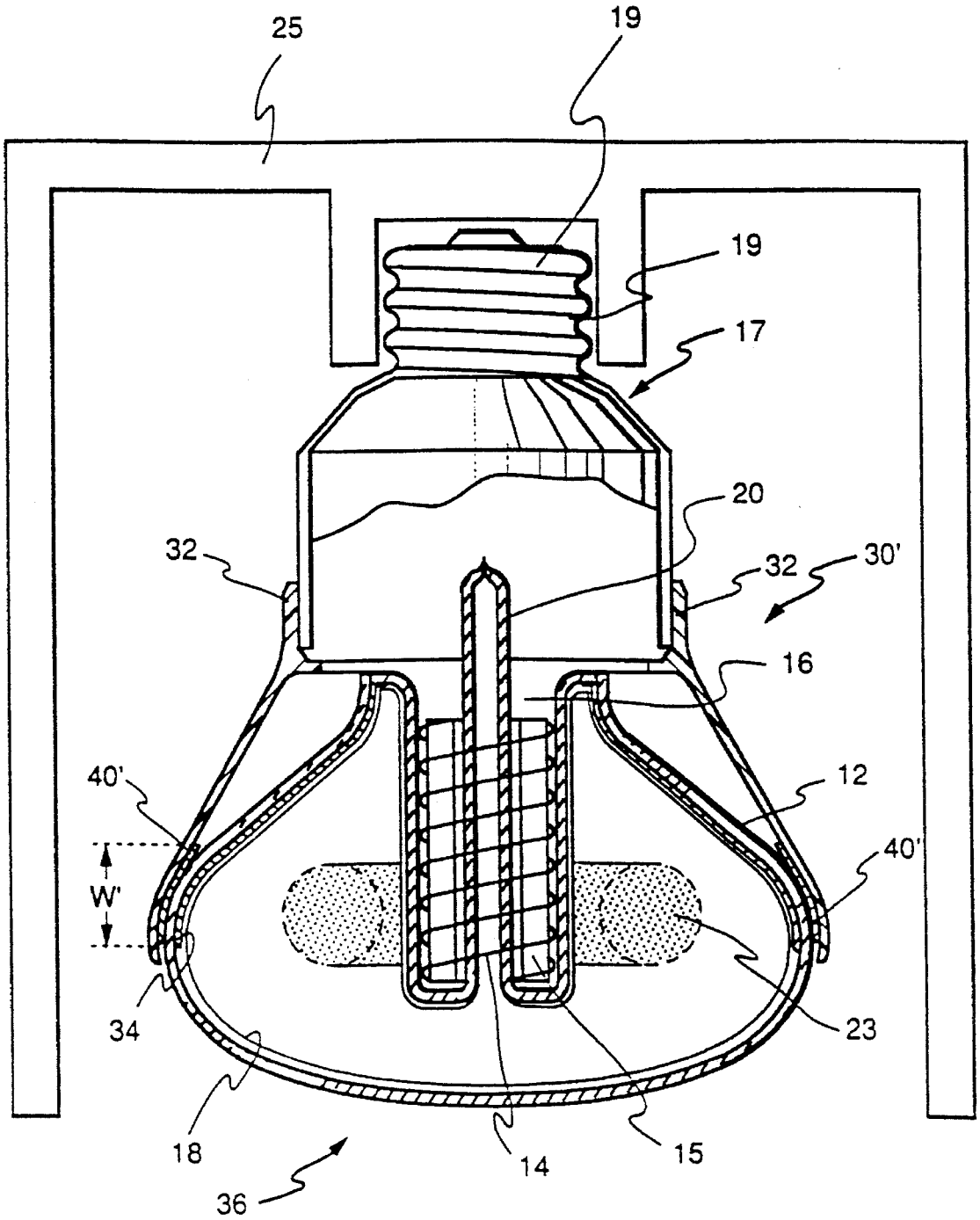
FIG. 3*a* illustrates, in partial cross section, one embodiment of an electrodeless fluorescent lamp according to the present invention.
Figure 3B:
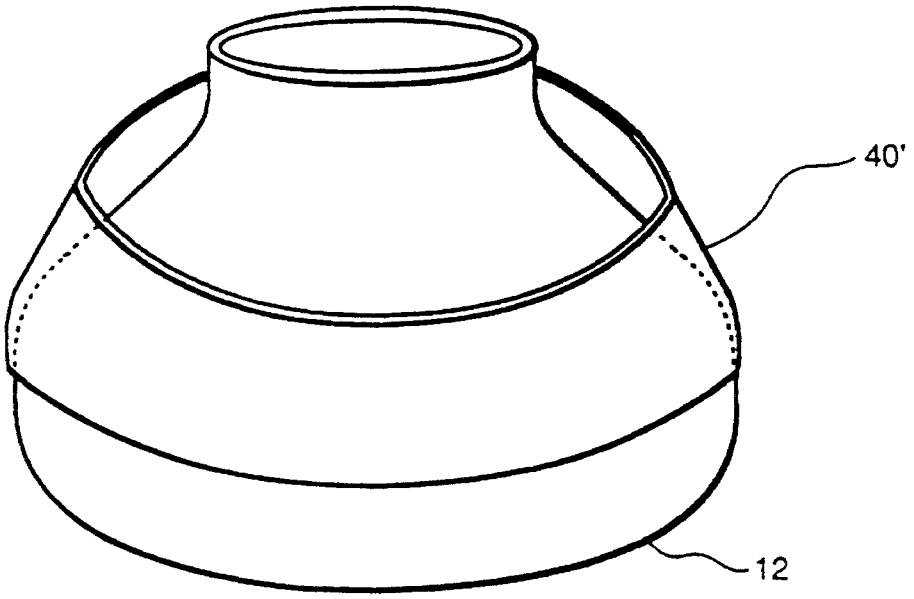
FIG. 3*b* is a perspective view of the shorted turn of the electrodeless fluorescent lamp of FIG. 3*a*.

FIGS. 3*a* and 3*b* illustrate an alternative embodiment of an electrodeless fluorescent lamp 30' according the present invention wherein a shorted turn 40' is significantly narrower (w'<w) than that of FIGS. 2*a* and 2*b*.

For any particular lamp configuration, the configuration of the shorted turn is optimized in terms of the location and amount of surface area occupied to minimize interaction with any metallic fixture and to avoid interfering with lamp starting and light output.

Advantageously, a shorted turn for an electrodeless lamp significantly reduces variations in lamp performance between operating in a conductive fixture and operating without a fixture.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An electrodeless discharge lamp, comprising:

a light-transmissive envelope containing an ionizable, gaseous fill for sustaining an arc discharge when subjected to an alternating magnetic field and for emitting radiation having a wavelength in a range from approximately 100 nm to 1000 nm as a result thereof, said envelope having a central portion and further having lamp base at one end thereof, said base being adapted for installation into a lamp fixture comprising an electrically conductive material;

an excitation coil situated proximate said envelope for providing said alternating magnetic field when excited by an alternating current energy source; and a shorted metal turn comprising a continuous conductor situated between said envelope and said fixture, said shorted metal turn covering a portion of said envelope, and said shorted metal turn minimizing electromagnetic interaction between said excitation coil and said fixture.

2. The lamp of claim 1, further comprising a dielectric housing situated about a portion of said envelope, said dielectric housing having an underside facing said envelope, said shorted metal turn being held in position between said envelope and said fixture.

3. The lamp of claim 1 wherein said shorted metal turn covers a portion of said envelope toward the central portion thereof.

4. The lamp of claim 2 wherein said shorted metal turn is attached to said dielectric housing.

5. The lamp of claim 2 wherein said shorted metal turn is attached to said envelope.

6. The lamp of claim 2 wherein said shorted metal turn is incorporated into said housing.

7. The lamp of claim 2 wherein said dielectric housing has an extension over said envelope beyond said shorted metal turn.

8. The lamp of claim 1, comprising an electrodeless fluorescent lamp, said arc discharge emitting ultraviolet radiation when subjected to said alternating magnetic field, said envelope having an interior phosphor coating for emitting visible radiation when excited by said ultraviolet radiation, said envelope further having a re-entrant cavity formed therein, said excitation coil being contained within said re-entrant cavity, said lamp further comprising a dielectric housing situated about a portion of said envelope.

9. The lamp of claim 8, further comprising a reflector situated about a reflector portion of said envelope for reflecting light through a light-emitting portion of said envelope situated opposite said reflector portion.

10. The lamp of claim 9 wherein said reflector comprises a reflective coating on said envelope.

11. The lamp of claim 9 wherein said dielectric housing covers said reflector portion of said envelope, and said shorted metal turn covers the underside of said dielectric housing.

12. The lamp of claim 9 wherein said dielectric housing covers said reflector portion of said envelope, and said shorted metal turn covers a portion of said reflector portion of said envelope toward the central portion thereof.

13. The lamp of claim 8 wherein said shorted metal turn is attached to said dielectric housing.

14. The lamp of claim 8 wherein said shorted metal turn is attached to said envelope.

15. The lamp of claim 8 wherein said shorted metal turn is incorporated into said housing.

16. The lamp of claim 8 wherein said dielectric housing has an extension over said envelope beyond said shorted metal turn.

17. The lamp of claim 1 wherein said dielectric housing comprises plastic.

18. The lamp of claim 1 wherein said shorted metal turn comprises copper.

* * * * *